United States Patent [19]

Hickey

[11] 4,397,455

[45] Aug. 9, 1983

[54] DOCUMENT DISPENSER WITH ESCROW SYSTEM

[75] Inventor: Richard C. Hickey, Plano, Tex.

[73] Assignee: Docutel Corporation, Irving, Tex.

[21] Appl. No.: 765,827

[22] Filed: Feb. 4, 1977

[51] Int. Cl.[3] ..... B65H 5/22

[52] U.S. Cl. ..... 271/3.1; 271/7; 271/34; 271/122; 271/154; 271/155; 271/263

[58] Field of Search ..... 271/3, 3.1, 4, 34, 262, 271/263, 122, 225, 234, 244, 152, 154, 155, 178, 7

[56] References Cited

U.S. PATENT DOCUMENTS

| | | | |
|---|---|---|---|
| 1,073,808 | 9/1913 | Lynch | 101/240 |
| 2,733,063 | 1/1956 | Corey | 271/263 |
| 3,125,337 | 3/1964 | Cruzen | 271/154 |
| 3,339,705 | 9/1967 | Burkhardt | 271/3.1 X |
| 3,568,860 | 3/1971 | Rawlins | 271/178 X |
| 3,679,202 | 7/1972 | Rauffer | 271/263 |
| 3,744,649 | 7/1973 | Ward | 271/3.1 X |
| 3,826,487 | 7/1974 | Förster | 271/263 |

FOREIGN PATENT DOCUMENTS

| | | | |
|---|---|---|---|
| 2538546 | 3/1976 | Fed. Rep. of Germany | 271/3.1 |

*Primary Examiner*—Richard A. Schacher
*Attorney, Agent, or Firm*—Richards, Harris & Medlock

[57] ABSTRACT

An apparatus for dispensing documents from a storage location to a discharge area includes structure for transporting the documents from the storage location along a transport path to an escrow or collection station. The leading and trailing edges of the document are positioned in a holding position removed from the transport path at the collection station so that successive documents may be loaded into the collection station. The apparatus includes a double detector for separating two documents removed at the same time from the storage location and for returning all but one of the simultaneously removed documents to the storage location. When the proper number of documents have been collected in the collection station, they are moved along the transport path and deflected to the discharge area by a divert gate positioned in the path of the collection of documents. However, the divert gate is positioned to deflect the documents to a divert bin where there has been an error in discharging documents from the storage location to the collection station. Thereafter, the dispensing cycle is repeated.

19 Claims, 9 Drawing Figures

DOCUMENT DISPENSER WITH ESCROW SYSTEM

BACKGROUND OF THE INVENTION

1. Field of the Invention

This invention relates to an apparatus for dispensing documents or paper currency and more particularly to a system for collecting a number of such documents at a collection station for subsequent simultaneous delivery.

2. Prior Art

Because document and paper currency dispensing devices are self-operating in that they function on the command of the user, they provide the convenience of 24 hour availability as well as the capability of being operated at numerous locations where such a service would not otherwise be feasible. Although these dispensing devices are "self operating", the systems must necessarily be accurate, error free and capable of dispensing paper currency upon command by the user in a convenient form and in quantities the user requires. Many prior art currency dispensing machines provide for the successive counting out of currency from a currency storage location. Others merely dispense a selected number of bills to a drawer which is subsequently opened to the user to permit withdrawal of the currency. These systems permit selective withdrawal of varied amounts of currency but do not provide an accurate method of control of the currency being paid out in that once the currency is dispensed there is no means of retracting the currency where an error in dispersement is made.

In order to accommodate both the accuracy requirement and to limit the complexity of the machines, some prior art systems limit the versatility of the payout capability by preassemblage of predetermined amounts of money in a folder for dispersal from the dispensing device. While the complexity of such systems is reduced and accuracy controlled, the ability of the user to request varied sums of money is necessarily limited. Moreover, these machines require the additional step of preassembling the currency for later delivery by the machine.

SUMMARY OF THE PRESENT INVENTION

The present invention provides an apparatus which overcomes many of the disadvantages heretofore found in the prior art systems for dispensing documents such as paper currency. The present invention provides a compact and relatively uncomplex apparatus for dispensing such documents either individually or in a quantity selected by a user. The system of the present invention also includes numerous failsafe features to ensure error free operation in the dispensing of the documents or paper currency.

In accordance with one embodiment of the invention, an apparatus for dispensing documents from a storage location to a discharge area includes structure for transporting the documents from the storage location along a transport path to a collection station. The leading and trailing edges of the document are positioned in a holding position removed from the transport path at the collection station. Thereafter, a collection of documents are moved from the collection station to the discharge area.

In accordance with a more specific embodiment of the invention, the leading edge of the document is positioned in a holding position removed from the transport path by a cylinder mounted for rotation at the collection station having at least one paddle radially extending from the cylinder and engaging an edge of the transported document. In one embodiment of the invention, the radially extending paddle comprises an elastomeric flipper. Similarly, a cylinder is mounted for rotation adjacent the trailing edge of the document positioned at the collection station and is fitted with a radially extending paddle to engage the trailing edge of the document to position it in a holding position removed from the transport path. In this way, successive documents may be transported from the storage location to the collection station without the interference of documents presently in the holding position.

In accordance with another embodiment of the invention, the apparatus for dispensing documents includes a double detector for separating two documents removed at the same time from the storage location and for returning all but one of the simultaneously removed documents to the storage location. In one embodiment of the invention, the double detector includes a first roller mounted in the transport path of documents removed from the storage location and a second roller mounted to a pivot arm juxtaposition the first roller and also in the transport path of documents removed from the storage location. A detector is provided for sensing the movement of the pivot arm as documents moved between the first and second rollers and generates a signal indicating a multiplicity of documents simultaneously moving between the rollers. In one embodiment of the invention, a vane is attached to and moves with the pivot arm in response to the movement of documents between the rollers. The vane moves between a light source and a light responsive detector when more than one document is fed between the rollers thereby generating a signal indicating that more than a single document has been discharged from the storage location. This signal, in turn, operates a separator system for returning all but one of the simultaneously removed documents to the storage location.

In one embodiment of the invention, when the proper number of documents have been collected in the collection station, they are moved along the transport path and deflected by a divert gate positionable in the path of the collection of documents to the discharge area. However, the divert gate is positioned to deflect the documents to a divert bin where there has been an error in discharging documents from the storage location to the collection station. Thereafter, the dispensing cycle is repeated.

In accordance with still a more specific embodiment of the invention, the dispensing apparatus includes a platform for supporting the documents and a detector responsive to the transporting of documents from the platform to elevate the platform such that the documents are maintained in a proper position for dispensing. A second detector responsive to the absence of documents on the platform stops the dispensing apparatus when the platform is empty of documents. In one embodiment of the invention, this detector includes a light source having its light beam directed toward the platform and a light responsive detector positioned adjacent the source and responsive to the light emitted therefrom. A reflector on the platform is formed to reflect light from the source to the detector when the platform is empty of documents thereby stopping the dispensing apparatus when the platform is empty.

DETAILED DESCRIPTION OF THE DRAWINGS

For a more complete understanding of the present invention, and for further details and advantages thereof, reference is now made to the following description taken in conjunction with the accompanying drawings in which.

DESCRIPTION OF THE PREFERRED EMBODIMENTS

Figure 1:
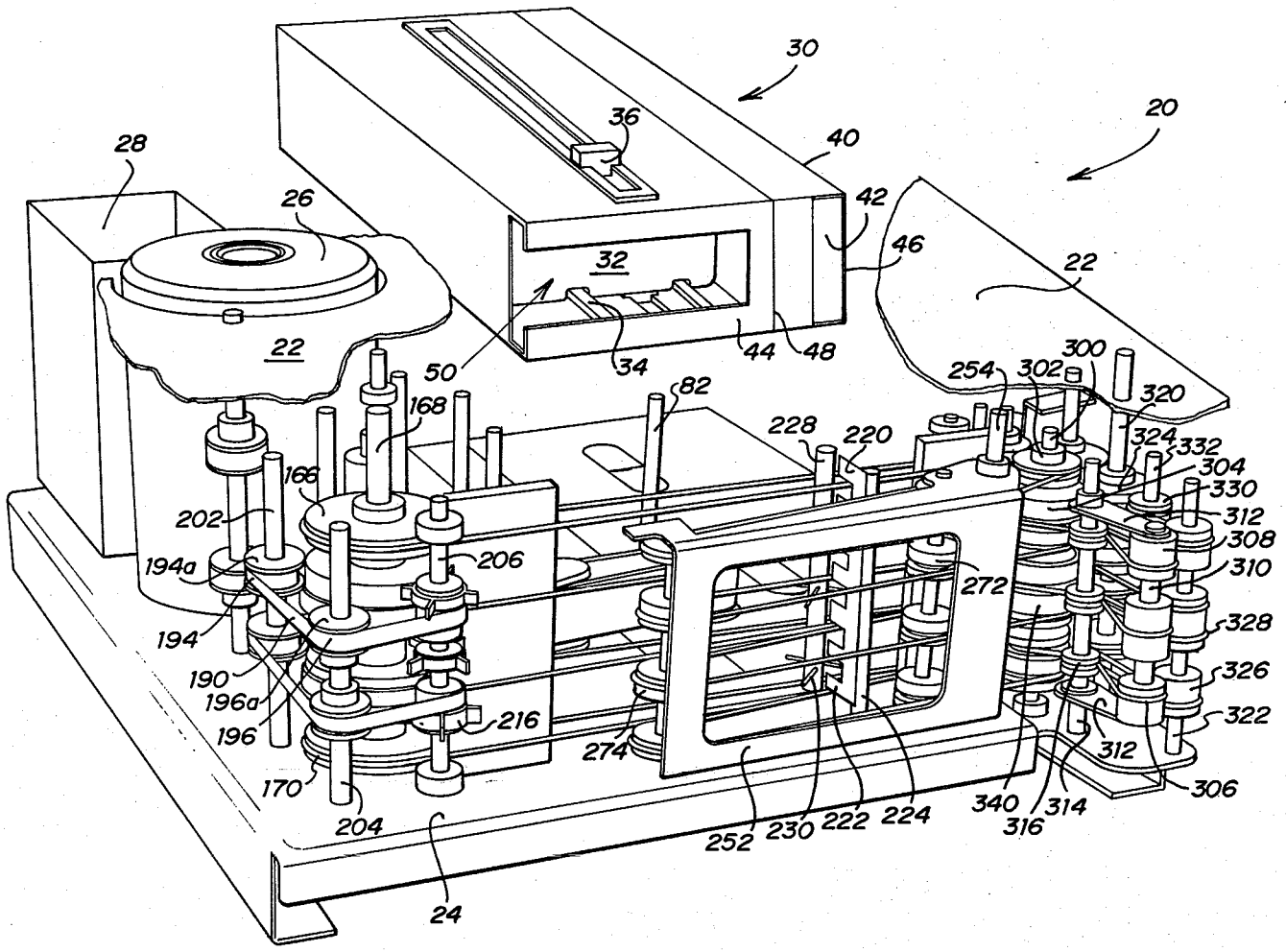
FIG. 1 is a partially broken away perspective view of the currency dispenser of the present invention.

FIG. 1 illustrates a perspective view of the document dispenser 20 of the present invention. In preferred embodiments of the invention, paper currency is the document dispensed although it will be apparent that other similar documents may likewise be handled by the present invention. The structure controlling the movement of paper currency dispensed by the apparatus is primarily housed between top plate 22 and a bottom plate 24. Dispenser 20 is illustrated with top plate 22 broken away to better reveal the structure of the dispenser apparatus. A motor 26 is attached to bottom plate 24 and drives the mechanism hereinafter to be discussed. A circuit box 28 positioned adjacent motor 26 houses a substantial portion of the electrical circuitry used in controlling the operation of the dispenser. A currency storage unit 30, shown removed from its in-place position, removably attaches to bottom plate 24. Storage unit 30 is fitted with a movable currency platform or elevator 32 having control fittings (not shown) that engage a belt on bottom plate 24 to drive the platform in such a manner as to allow for removal of currency storage unit. A divert bin 40 is positioned adjacent elevator 32 and is fitted with two doors 42 and 44 which pivot inwardly about axis shafts 46 and 48, respectively.

Figure 2:
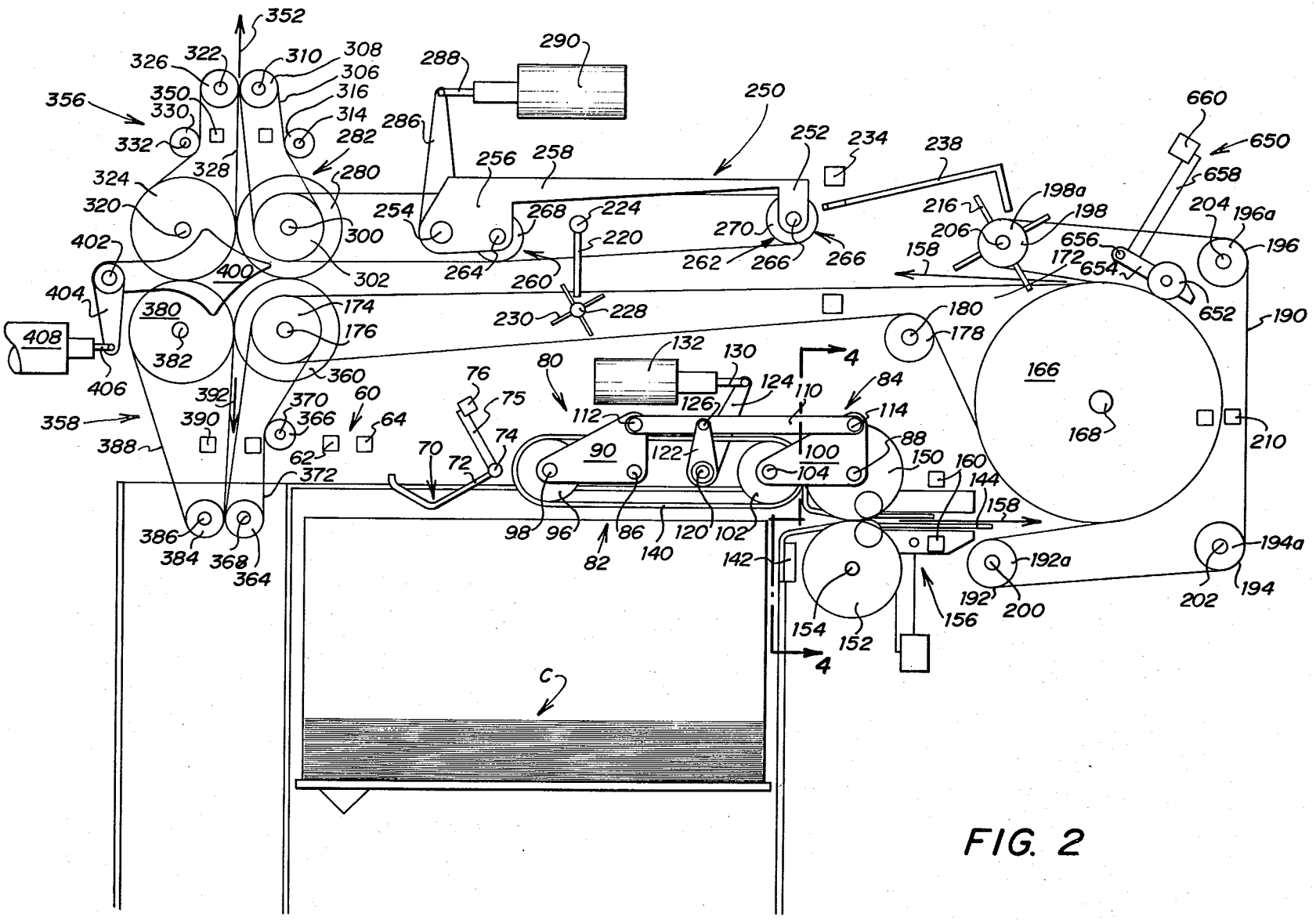
FIG. 2 is a partial section view of the dispenser illustrated in FIG. 1.
Figure 3:
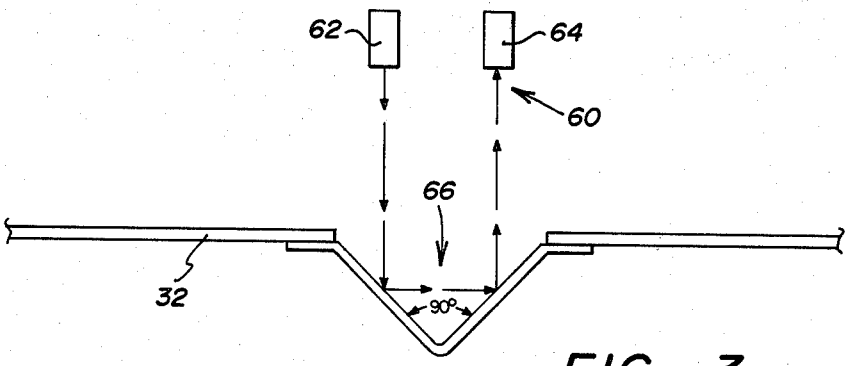
FIG. 3 is an enlarged view of a document presence detector of the dispenser of FIG. 1.

As is best seen in viewing FIG. 1 in conjunction with FIG. 2, with storage unit 30 in place, currency elevator 32 positions currency bills C to a top opening 50 of storage unit 30 and in position to begin delivery through the dispensing apparatus. In one embodiment of the invention, a sensor unit 60 (FIGS. 2 and 3) detects the presence or absence of currency C within storage unit 30 and prevents operation of the apparatus when the storage unit is empty of currency. Sensor unit 60 includes a light source 62 and a light responsive photosensor detector 64 for detecting the reflection of light from the source 62 and determining the presence or absence of currency bills in storage unit 30. When currency is present on currency elevator 32, light emitted from light source 62 is absorbed by the currency and therefore undetected by photosensor 64. However, the portion of currency elevator 32, immediately opposite light sensor 62 and photosensor 64, includes a 90 degree included angle groove 66 such that light emitted from light source 62 is reflected onto photosensor 64 whenever there is no currency on currency elevator 32. With the 90 degree included angle of groove 66 and the parallel axis orientation of the light source 62 and detector 64, there is provided parallel beams of incident and reflection despite any system misalignment. The angle of groove 66 and the parallel mounting of source 62 and detector 64 also eliminate false signals due to paper reflection. Therefore, whenever photosensor 64 detects light as a result of the reflection from the groove 66 from light source 62, a signal is transmitted to a controller which prevents the continued operation of the apparatus.

Referring to FIG. 2, sensor unit 70 controls the upward movement of currency elevator 32 as currency is dispensed therefrom. Unit 70 includes an arm 72 supported for rotation on a shaft 74. Arm 72 is biased downwardly to engage currency carried on currency elevator 32. A vane 75 is attached to arm 72 and passes through a sensor unit 76. Sensor unit 76 includes a phototransistor and a light emitting diode (L.E.D.) positioned on opposite sides of vane 75. As the currency supported by currency elevator 32 drops below a predetermined level, arm 72, and thus vane 75, rotate counter-clockwise as seen in FIG. 2. Vane 75 moves from between the phototransistor and L.E.D. of the sensor unit 76 resulting in the emission of a signal to a controller which raises currency elevator 32. In this way, elevator 32 is maintained in a position to continuously provide currency at the upper opening of storage unit 30.

A pick assembly 80 is supported between top and bottom plates 22 and 24 and operates to remove currency from upper opening 50 in storage unit 30 and also controls the sensor unit 70 by an interconnection therewith. This means that sensor unit 70 is enabled only when pickup assembly 80 is moved into contact with the currency stack. Pick assembly 80 includes two identical pick roller assemblies 82 and 84 including an axis shaft 86 and 88, respectively. Spaced parallel triangular arms 90 (only one shown) are fixed for attached rotation with axis shaft 86 and a roller 96 is supported for rotation about shaft 98 such that rotation of roller 96 is parallel to shaft 86. Similarly, a pair of spaced parallel triangular arms 100 (only one shown) are fixed for rotation with axis shaft 88 and support a roller 102 on axis shaft 104 for rotation parallel to axis shaft 88. The corners of arms 90 and 100 opposite axis shafts 86 and 88, and 98 and 104, are joined by parallel lever arms 110 (only one shown) which are pinned to triangular arms 90 and 100 by pins 112 and 114 respectively.

A shaft 120 is supported between top and bottom plates 22 and 24 and is adapted with arms 122 and 124 for rotation therewith. The end of arm 122 remote from shaft 120 is pinned to lever 110 by pin 126 intermediate of its points of connection to arms 90 and 100. The end of lever 124 remote from shaft 120 is fixed to the moveable arm 130 of pick solenoid 132. It may be seen that by the actuation of pick solenoid 132 to retract arm 130, the movement of lever 110 rotates arms 90 and 100 about shafts 86 and 88, respectively, thereby simultaneously rotating rollers 96 and 102 downwardly.

A flexible belt 140 is entrained about rollers 96 and 102. Belt 140 is of a rubberized or synthetic material having properties for gripping the paper currency in which in comes in contact. Thus, by retracting the movable arm 130 of pick solenoid 132, rollers 96 and 102, and therefore belt 140 is lowered against the upper surface of the uppermost currency bill exposed through top opening 50 in storage unit 30.

A front separator roller 150 and a rear separator roller 152 are mounted for rotation on shaft 88 and shaft 154, respectively. A mechanical doubles detector 156 is mounted to one side of separator rollers 150 and 152 and is positioned to receive currency therebetween as the currency is fed by belt 140 through upper and lower separator rollers 150 and 152 along the transport path indicated generally by arrows 158. A first pair of photosensors 160 are positioned on opposite sides of the transport path and immediately adjacent the point at which currency exits through doubles detector 156.

Figure 4:
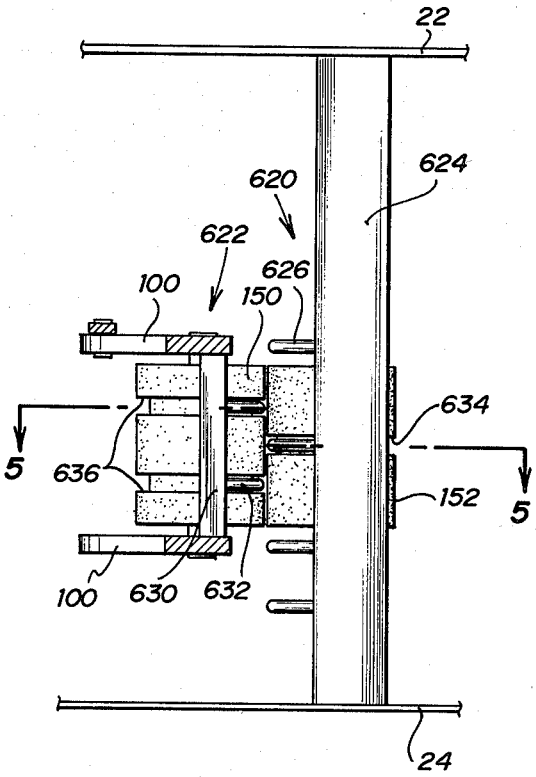
FIG. 4 is a section view taken along line 4—4 of FIG. 2 looking in the direction of the arrows.
Figure 5:
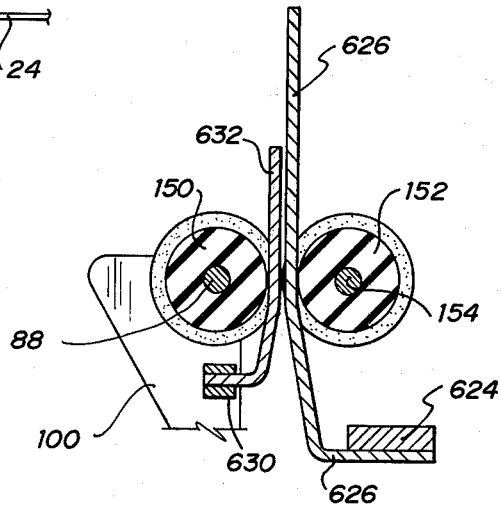
FIG. 5 is a section view taken along line 5—5 of FIG. 4 looking in the direction of the arrows.

Referring to FIGS. 4 and 5, a pair of guide assemblies 620 and 622, cooperate with separator rollers 150 and 152 to direct currency from the currency stack into engagement between the separator rollers. Guide assembly 620 includes a bar 624 supported between top and bottom plates 22 and 24. A plurality of fingers 626 are attached to and extend from bar 624 along the transport path indicated by arrow 158. Guide assembly 622 likewise includes a bar 630 supported between triangular arms 100 with fingers 632 extending therefrom and along the transport path. Rollers 150 and 152 have grooves 634 and 636, respectively, formed therein and guide fingers 626 and 632 are aligned within these grooves such that the surfaces of separator rollers 150 and 152 may be in surface contact without engaging fingers 626 and 632. Referring specifically to FIG. 5, it is seen that fingers 626 and 630 direct currency dispensed from the currency stack between separator rollers 150 and 152 without contacting or interferring with these rollers.

As can be seen in both FIGS. 1 and 2, four drive rollers 166 are supported for rotation on shaft 168. Rollers 166 are formed with a groove 170 around the circumference thereof. Each of drive rollers 166 supports an expandable band 172 which is entrained between rollers 166 and pulleys 174 supported for rotation about shaft 176. Idle rollers 178, rotatable on shaft 180, are positioned to lengthen the course for bands 172 to tension the bands while displacing them from the area in which pick assembly 80 is positioned in the system.

A set of belts 190 are entrained about the two center drive rollers 166 and idle roller assemblies 192, 194, 196, and 198. Idle roller assembly 192 is a solid roller member having longitudinal grooves around the outer circumference for mating with belts 190 as will hereinafter be described. Idle roller assemblies 194 and 196 include rollers **194*a*, 194*b* and 196*a*, 196*b*, respectively, supported for rotation with axis shafts 202 and 204, respectively. Similarly, idle roller assembly 198 consists of rolles 198*a*, 198*b* and 198*c* supported for rotation on axis shaft 206. A plurality of elastomer flipper paddles 216 are fitted on rollers 198*a–c* for rotation with idle roller assembly 198**.

In one embodiment of the invention, each of the rollers on roller assemblies 192, 194, 196 and 198 have transverse grooves about their outer circumference to receive the transverse ribs formed on the inner surface of belts 190. In this configuration, the reverse side of belts 190 are flat and contact the circumference of drive rollers 166 overlapping bands 172 as they move in grooves 170 of drive rollers 166. A second pair of photosensors 210 are positioned intermediate of the inside drive rollers 166 with the elements of each pair being positioned on opposite sides of the transport path defined by the outer circumference of drive rollers 166.

Figure 6:
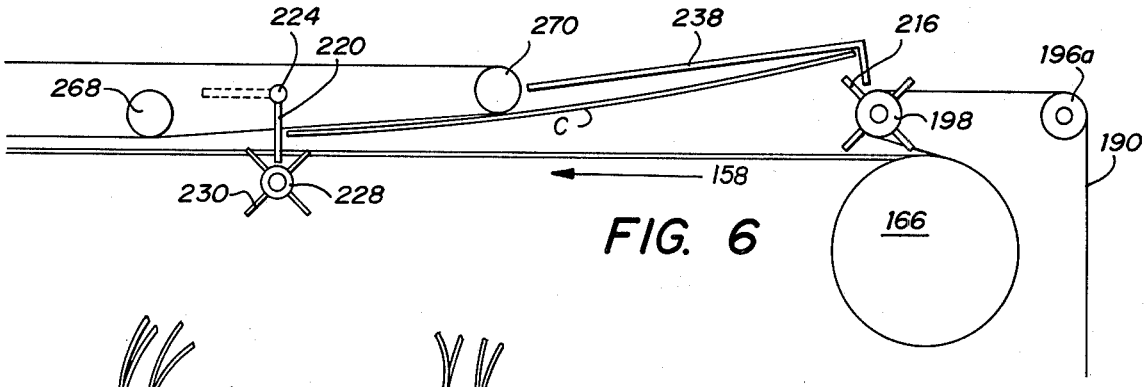
FIG. 6 is an enlarged section view of the collection or escrow station showing documents positioned therein.

Referring now to FIGS. 1, 2 and 6, a retractable stop gate 220 is supported between top and bottom plates 22 and 24 and includes a plurality of fingers 222 extending from a shaft 224. Fingers 222 are positioned to normally extend in the course of the transport path 158 downwardly to the side of bands 172. A rotating shaft 228 is positioned adjacent the tips of fingers 222 of gate 220 and is fitted with a plurality of flexible fingers 230 which are spaced along shaft 228 to pass between fingers 222 and out of the way of bands 172. A third pair of photosensors 234 are positioned intermediate of the elastomer flipper paddles 216 and gate 220 with the elements of the pair positioned on opposite sides of transport path 158.

An escrow or collection station is defined by the area between flipper paddles 216 and gate 220 (FIG. 6). A shield 238 is fixed between the top and bottom plates 22 and 24 and adjacent flipper paddles 216. The end of shield 238 is cut away to permit the movement of paddles 216 therethrough without contact.

Referring now to FIG. 2, an escrow platform 250 includes a cage structure 252 supported for rotation about a pivot shaft 254. Cage 252 is formed with sidewalls 256 extending from rectangular top structure 258. Two pulley systems 260 and 262 are supported between sidewalls 256 and each include a shaft 264 and 266, respectively, with four pulleys 268 and 270, respectively, supported for rotation with each. Pulleys 268 and 270 are provided with grooves 272 and 274, respectively, around the entire circumference thereof for receiving expandable bands 280 entrained thereabout and about a pulley assembly 282 which will be described in greater detail hereinafter. Shaft 254 is fitted with a lever arm 286. The end of lever arm 286 remote from shaft 254 is attached to the plunger rod 288 of escrow station solenoid 290. Because the escrow platform 250 moves with the rotation of shaft 254, it can be seen that by retracting the plunger rod 288 of escrow station solenoid 290, escrow platform 250 can be made to rotate clockwise, as seen in FIG. 2, thereby engaging bands 280 against any currency supported on bands 172 as it moves along transport path 158.

Pulley assembly 282 rotates on shaft 300 supported between top and bottom plates 22 and 24 and includes four grooved pulleys 302 for receiving bands 280 thereby functioning as a part of escrow platform 250. Pulley assembly 282 further includes at least three similar grooved pulleys 304. Three expandable bands 306 are entrained about pulleys 304 and also about pulleys 308 supported on axis shaft 310 between moveable arms 312 extending from axis shaft 314. Idle rollers 316 are supported on axis shaft 314 and tension the expandable bands 306 thereby tending to rotate arms 312 and pulleys 308 counterclockwise as viewed from FIG. 2 in toward the adjacent pulley systems. Similarly, axis shafts 320 and 322 support grooved pulleys 324 and 326, respectively, about which expandable bands 328 are entrained. Idler rollers 330 are supported for rotation on axis shaft 332. These rollers tension bands 328 while assisting in retaining them on their course. Another set of pulleys 340 supported for rotation on shaft 300 are positioned in line with pulleys 324. Pulleys 340 contact bands 328 thereby insuring their rotation in unison with the rotation of pulley assembly 282.

A fourth pair of photosensors 350 are supported from shaft 314 and 332, respectively, with the elements of the pair being positioned on opposite sides of the exit port path indicated by arrow 352.

The assembly formed by the pulleys on shafts 300, 310, 314, 320, 322, and 332 are generally designated as the exit port assembly 356. A divert port assembly 358 is provided identical to the exit port assembly 356 but positioned opposite to exit port assembly 356. Specifically, the divert post assembly includes shaft 176 supporting pulleys 174 and 360. Pulleys 364 and 366 are supported for rotation about shafts 368 and 370, respectively. Bands 372 are entrained about pulleys 364 and pulleys 360.

The rearward portion of divert port assembly 358 includes pulleys 380 supported for rotation on shaft 382 and pulleys 384 supported for rotation on shaft 386. An expandable band 388 is fitted in grooves within pulleys 380 and 384 and is entrained thereabout. A fifth pair of photosensors 390 are positioned with its elements on opposite sides of a divert path indicated generally by the arrow 392 between the forward and rearward portions of divert port assembly 358.

A divert gate 400 is attached for rotation about shaft 402 suspended between top and bottom plates 22 and 24, respectively. The end of gate 400 remote from shaft 402 is shaped as a spear to divert currency moving along the transport path either through the exit port along the path indicated by arrow 352 or the divert port along the path indicated by the arrow 392. A lever arm 404 is attached to shaft 402 and its end remote from shaft 402 is attached to the movable plunger rod 406 of divert solenoid 408. Therefore, by actuation of divert solenoid 408, divert gate 400 may be positioned such that its point remote from shaft 402 diverts currency either to the exit port or to the divert port as viewed from FIG. 2.

Figure 7:
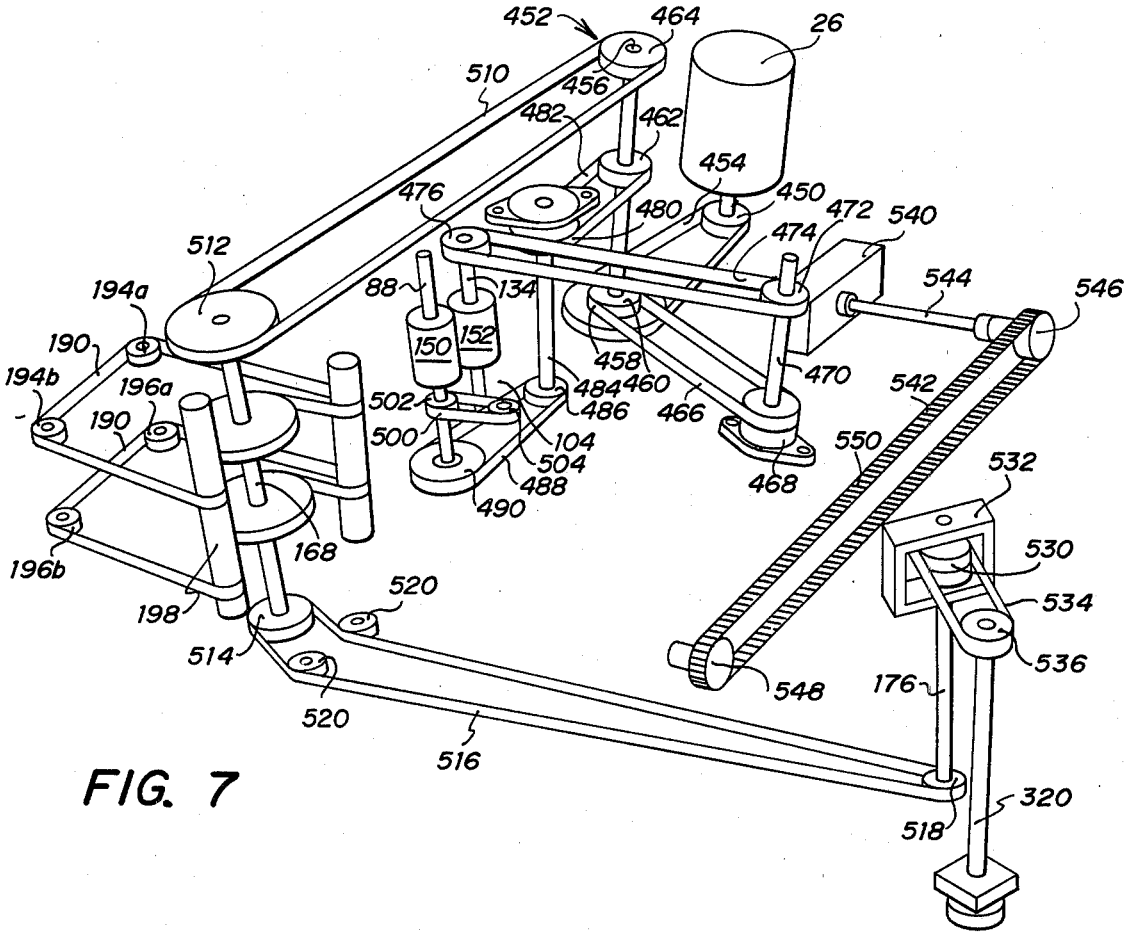
FIG. 7 is a perspective view showing the pulley assembly and belt arrangement for controlling the operation of the present invention.

Referring now to FIG. 7, the structure described in FIGS. 1 and 2 is operated by the belt system therein disclosed. Power for the belt system is provided by motor 26 that drives a pulley and shaft assembly 450 and pulley and shaft assembly 452 by way of belt 454. Shaft 456 of pulley assembly 452 is supported for rotation between top and bottom plates 22 and 24 as are each of the other shafts described with respect to FIG. 7 with the exception of the currency elevator belt system to be discussed in greater detail hereinafter. Shaft 456 supports a pulley 458 which receives belt 454 entrained about pulley and shaft assembly 450 of motor 26. In this way, shaft 456 is rotated in conjunction with the rotation of motor 26 and pulleys 460, 462, and 464 attached to shaft 456 rotate therewith. A belt 466 is entrained around pulley 460 and a clutched pulley 468 is supported for rotation on shaft 470. Pulley 468 freely rotates on shaft 470 and may be selectively engaged to shaft 470 to cause rotation thereof. A pulley 472 is fixed to shaft 470 and rotates therewith. Separater roller 152 and shaft 154 therethrough are rotationally attached to shaft 470 by a belt 474 entrained about pulley 472 of shaft 470 and pulley 476 attached for rotation with shaft 154.

With motor 26 operating, separater roller 152 may be selectively rotated by actuating clutch pulley 468 to engage shaft 470. A second clutched pulley system 480 communicates with pulley 462 by way of a belt 482 entrained thereabout. Clutch pulley 480 may be actuated to engage shaft 484 on which pulley 480 is fitted to cause rotation thereof. Pulley 486 is attached for rotation with shaft 484 and transmits rotation to separater roller 150 and shaft 88 therethrough by belt 488 entrained about pulley 486 and a pulley 490 attached for rotation with shaft 88. Therefore, when motor 26 is operating, the actuation of clutch pulley 480 to engage shaft 484 permits selective rotation of separator roller 150. It will be noticed that the rotation of the separater rollers is in the same direction when both clutch pulley assemblies 468 and 480 are actuated to engage their respective shafts.

Axis 88 is fitted with a belt and pulley 500 and 502, respectively, for transmitting rotation to pulley 504 attached for rotation with shaft 104. Shaft 104, as hereinbefore discussed with respect to FIG. 2, is the shaft on which pick roller 102 rotates. In this way, the rotation of pick roller 102 and pick roller 96 by way of belt 140 is accomplished.

Pulley 464 of shaft 456 transmits rotation to drive rollers 166 by belt 510 entrained about pulley 464 and pulley 512 attached to drive roller shaft 168. The rotation of drive roller shaft 168 and the accompanying rotation of drive roller 166 results in the rotation of belt 190 and the pulley assemblies defining the course of belt 190.

A pulley 514 is attached at the end of drive roller shaft 168 opposite the attachment of pulley 512 thereto and transmits rotation to shaft 176 by belt 516 entrained about pulley 514 and pulley 518 attached to shaft 176. Take up rollers 520 are positioned in the course of belt 516 and apply tension thereto.

As discussed earlier with respect to FIG. 2, shaft 176 is adapted with a plurality of pulleys and bands for controlling the movement of currency through the dispenser apparatus. The end of shaft 176 remote from pulley 518 is adapted with a clutch pulley 530 supported in a cage 532 attached to top plate 22 (not shown). Clutch pulley 530 may be actuated to selectively engage shaft 176 and thereby transmit rotation to shaft 320 by belt 534 entrained about pulley 530 and pulley 536 attached for rotation with shaft 320. As was discussed with respect to FIG. 2, shaft 320 is also fitted with a plurality of pulleys for driving the bands used to control the movement of currency through the present dispenser.

A separate motor 540 attached to bottom plate 24 (not shown in FIG. 7) drives a currency elevator belt 542 by rotating drive shaft 544 and pulley 546 attached thereto. Currency elevator belt 542 is entrained about pulley 546 and pulley 548 both of which rotate within bottom plate 24. Currency elevator belt 542 is formed with raised ribs 550 along the outer surface thereof formed transverse to the longitudinal dimension. Ribs 550 engage fitting 34 attached to elevator platform 32 to position the platform 32 as currency is dispensed from storage unit 30.

In the operation of the dispenser, as was discussed earlier, sensor unit 70 directs an impulse to a controller whenever arm 72 rotates below a predetermined level. This controller controls motor 540 which operates pulley 546 to move belt 542 thereby positioning currency elevator 32. As the currency is moved in the storage unit, arm 72 of sensor 70 is raised above the predetermined level and the signal emitted therefrom to the controller is terminated. As currency is dispensed from the storage unit, the cyclic process continues such that currency is continuously elevated to be dispensed by the system.

When the proper command impulse is input into the dispenser, drive motor 26 and clutch pulley 480 (FIG. 7) are actuated to cause rotation of shafts 484, 88 and 104 (FIG. 7) thereby rotating pick rollers 102 and 96 and pick roller belt 140 (FIG. 2). It will also be noticed that simultaneously with the rotation of shaft 88, separator roller 150 is set into rotation and because of the surface contact between separator roller 150 and separator roller 152, roller 152 is set into motion rotating in a direction opposite to the rotation of roller 150. Likewise, with the operation of motor 26, drive rollers 166 are set into motion as are belts 190 positioned thereabout.

Pick solenoid 132 is energized on command to draw in arm 130 thereby rotating pick rollers 96 and 102 and belt 140 entrained thereabout downwardly against the currency supported on elevator platform 32. Currency is fed individually between separator rollers 150 and 152 and through the double detector 156. Fingers 626 and 632 of guide assemblies 620 and 622 direct currency between separator rollers 150 and 152.

Figure 8:
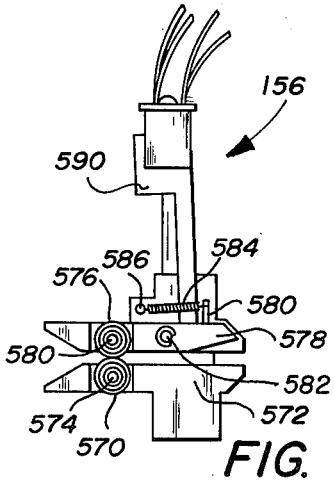
FIG. 8 illustrates a side view of the double detector of the present invention.
Figure 9:
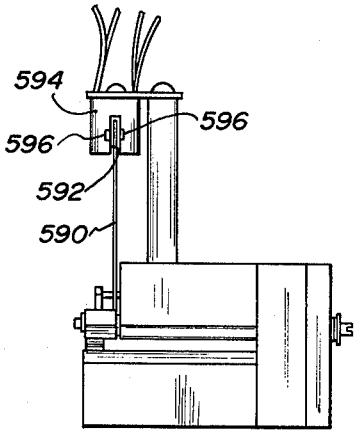
FIG. 9 is an upstream view of the double detector of FIG. 8.

FIGS. 8 and 9 illustrate in detail double detector 156 which senses the presence of double thicknesses of currency thereby indicating when more than one paper bill is dispensed therethrough. Double detector 156 includes a roller 570 supported for rotation in a fixed structure 572 on shaft 574. A corresponding roller 576 is attached for rotation on lever arm 578 by way of shaft 580. Lever arm 578 is pinned to pivot about pivot pin 582. Spring 584 is attached between super structure 586 and lever arm 578 to bias roller 576 against roller 570. A vane 590 is attached to lever arm 578 and extends therefrom to pass between an aperture 592 of housing 594 wherein a sensor pair including a phototransistor and a light emitting diode (L.E.D.) 596 are positioned. The light emitting diode and the phototransistor are positioned on opposite sides of the aperture.

As currency passes between rollers 570 and 576, the thickness of the currency causes lever arm 578, and thus vane 590 attached thereto, to rotate about pivot pin 582. The mechanical amplification of the separation between rollers 570 and 576 as a result of the movement of currency therebetween is $3\times1$ so that the movement of the vane at aperture 592 is three times the movement of roller 576. Vane 590 is mounted relative to a sensor 596 including a phototransistor light emitting diode pair. Vane 590 is positioned such that the movement as a result of the passage of a single currency bill through the doubles detector does not cause vane 590 to move between the phototransistor and L.E.D. However, when more than one bill of currency moves between rollers 570 and 576, vane 590 is caused to move between the phototransistor and L.E.D. thereby resulting in the emission of a signal to a controller energizing clutch pulley 468 to rotate lower separater roller 152 counterclockwise as seen in FIG. 2. When the electric clutch is energized to rotate roller 152 in counter-clockwise direction (as shown in FIG. 2) the electric clutch which drives roller 150 in counterclockwise direction is deenergized and a one-way (overrunning) clutch is attached to roller 150 to prevent clockwise rotation.

Therefore, where two currency bills are positioned between the rollers 570 and 576, the lower bill is forced back into storage unit 30 while the upper bill continues to be projected along transport path 158 by separater roller 150 which is re-energized to move the currency through the dispenser.

When the leading edge of a piece of currency passes between the first pair of photosensors 160, a signal is emitted to a controller and pick solenoid 132 is disengaged thereby retracting pick rollers 96 and 102. The doubles detector remains active and prevents any currency other than a single piece thereof from being dispensed through the separater rollers. As the currency is moved forward by the separater rollers along the transport path indicated generally by the arrow 158, the leading edge is engaged between drive rollers 166 and belts 190 such that it is carried around drive rollers 166 into the area designated as the escrow or collection station.

When the leading edge of the currency being dispensed passes between the second pair of photosensors 210, clutch pulley 480 is disengaged such that the upper separater roller 150 is no longer driven. The separater system continues in operation, however.

As the currency moves into the escrow station, it is carried forward by and supported on bands 172. The movement of the currency is arrested by the contact of its leading edge against retractable stop gate 220. As can be seen more clearly in FIG. 6, the counter clockwise rotation (as viewed in FIG. 6) of shaft 228 and fingers 230 attached thereto lifts the forward edge of currency C out of the transport path indicated by arrow 158. Likewise, the clockwise rotation (as viewed in FIG. 6) of elastomer flipper paddles 216 about shaft 206 forces the trailing edge of currency C upwardly against shield 238 thereby removing the entire currency bill C out of the transport path such that successive currency bills may be delivered to the escrow station without interference by bills stored therein. When the trailing edge of currency bill C passes the photosensor 210, the next dispense operation is initiated and a successive number of currency bills are dispensed into the escrow station as indicated by the control system.

After the required number of bills have been fed into the escrow station, both the divert solenoid 408 and the escrow station solenoid 290 are energized to retract rods 406 and 288, respectively. This causes the escrow platform 250 to rotate about its pivot shaft 254 and the simultaneous rotation of stop gate 220 to the positions shown in phantom in FIG. 6. As the rotating bands 280 within escrow platform 250 contact the bundle of currency in the escrow station, and in conjunction with the rotation of bands 172 below such currency, the bundle of currency is projected along the transport path and through the exit port along the path indicated generally by the arrow 352. It will be noticed that the retraction of rod 406 of divert solenoid 408 has at this point caused the rotation of divert gate about its axis shaft 402 to guide the bundle of bills through the exit port. When the leading edge of the bundle of currency covers the fourth pair of photosensors 350 a signal is deployed to a controller starting a timer. When time elapses sufficient to feed the bundle out of the exit port, escrow station solenoid 290 and divert solenoid 408 are disengaged thereby rotating escrow platform 250 and divert gate 400 counter clockwise as viewed in FIG. 2.

As currency passes between the second pair of photosensors 210 a signal is emitted to a controller starting a timer. If the photosensor 210 is not uncovered in the time required for one bill of currency to move past photosensor 210, a signal is transmitted to a controller to abort the dispense operation as it is known that a second bill is overlapping and trailing the first bill being dispensed. In this case, all of those bills collected in the escrow station are moved past stop gate 220 by the actuation of escrow platform against the currency through actuation of escrow station solenoid 290. However, in this mode, divert gate 400 is maintained in the position to divert the bundle of currency through divert port along the path indicated generally by arrow 392. This currency is collected in divert bin 40 and remains within the system. Photosensor 390 indicates when this operation has been completed and the dispensing operation is then reactivated to begin the dispense operation anew. Sensors 234 positioned on opposite sides of the escrow station verify that the escrow station has been emptied and a signal is directed to a controller which permits the restarting of the dispense operation.

Referring to FIG. 2, a second double detector 650 provides a further check to prevent the passage of more than one bill around drive rollers 166. Double detector 650 is substantially identical to double detector 156 illustrated in detail in FIGS. 8 and 9, and includes a roller 652 supported for rotation on an arm 654 pivoted on an axis shaft 656. Axis shaft 656 is supported between the top and bottom plates 22 and 24. A vane 658 is attached to and rotates with arm 654 and passes between a sensor unit 660. Sensor unit 660 includes a phototransistor and a light emitting diode (L.E.D.) positioned on opposite sides of vane 658. Roller 652 and arm 654 are biased against rollers 166. As currency passes between rollers 652 and 166, the thickness of the currency causes lever arm 654, and thus vane 658, to rotate about axis shaft 656. When more than one bill of currency moves between these rollers, vane 658 moves between the phototransistor and light emitting diode causing a signal to be transmitted to a controller which clears all of the bills from the escrow station into the divert bin. The dispenser is then programmed to begin the dispense process again.

Therefore, the present invention provides a compact and relatively uncomplex apparatus for dispensing documents such as paper currency either individually or in quantities selected by a user. The system includes numerous failsafe features to ensure error free operation in the dispensing of the documents such that neither too few nor too many are dispensed to the user. The present invention includes a doubles detector which operates to separate currencies dispensed from the storage unit more than one at a time and sensors used in conjunction with timing devices to indicate whether more than one bill has been moved from the storage unit to an escrow station. The documents or currency are collected in the escrow station prior to dispensing to the user thereby permitting all of the currency to be dispensed simultaneously as well as permitting the dispensing cycle to be aborted where the documents or currency are not accurately dispensed to the escrow station. Therefore, the escrow station provides the dispensing apparatus with an additional failsafe check point prior to dispersing the documents or currency to the user.

Whereas the present invention has been described with respect to specific embodiments thereof, it will be understood that various changes and modifications will be suggested to one skilled in the art, and it is intended to encompass such changes and modifications as fall within the scope of the appended claims.

What is claimed is:

1. Apparatus for dispensing documents from a storage location to a discharge area, comprising in combination:

means for transporting doucments from the storage location along a transport path, means for continously positioning documents in the storage location to the transport path as documents are transported therefrom, means responsive to said positioning means for stopping the dispensing when the storage location is empty.

a collection station at the end of the transport path and displaced laterally therefrom, said collection station including:

first means immediate the end of the transport path for displacing the trailing edge of a document from the transport path into the collection station, second means at the opposite end of the collection station from said first means for displacing the leading edge of a document delivered from the transport path into the collection station, and means for moving documents at the collection station to the discharge area.

2. Apparatus for dispensing documents as set forth in claim 1 wherein said means for positioning documents comprises:

a platform for supporting the documents, means responsive to the transporting of documents from said storage location to elevate said platform such that the documents are successively positioned in the transport path.

3. Apparatus for dispensing documents as set forth in claim 1 further comprising:

a guide assembly positioned along the transport path of the documents, and said guide assembly having fingers extending in the direction of and on opposite sides of the transport path thereby guiding said documents along the transport path.

4. Apparatus for dispensing documents from a storage location to a discharge area, comprising in combination:

means for transporting documents from the storage location along a transport path, a collection station at the end of the transport path and displaced laterally therefrom, said collection including:

first means immediate the end of the transport path for displacing the trailing edge of a document from the transport path into the collection station, second means at the opposite end of the collection station from said first means for displacing the leading edge of a document from the transport path into the collection station, a pivotable platform frame positioned adjacent the collection station, a roller assembly supported for movement with said platform frame, bands entrained around said roller assembly and rotatable thereabout, and means for pivoting said platform frame such that said bands engage the documents assembled at the collection station to carry the documents to the discharge area.

5. Apparatus for dispensing documents from a storage location to a discharge area, comprising in combination:

means for transporting documents from the storage location along a transport path, a double detector that generates a first signal indicating that only a single document is moving through the transport path and generating a second signal indicating that multiple documents are moving together through the transport path, a collection station at the end of the transport path and displaced laterally therefrom, said collection station including:

first means immediate the end of the transport path for displacing the trailing edge of a document from the transport path into the collection station, second means at the opposite end of the collection station from said first means for displacing the leading edge of a document delivered from the transport path into the collection station, and means for moving documents at the collection station to the discharge area when said double detector generates an indication that only single documents have been moved from the storage location.

6. Apparatus for dispensing documents as set forth in claim 5 wherein said double detector includes:

a first roller mounted in the transport path of documents removed from the storage location, a pivot arm, a second roller mounted to the pivot arm juxtaposition said first roller and also in the transport path of documents removed from the storage location, and means responsive to the movement of the pivot arm as documents move between said first and second rollers for generating the first and second signals.

7. Apparatus for dispensing documents as set forth in claim 6 wherein said means responsive to the movement of the pivot arm includes:

a light source, a light responsive detector positioned from said source and responding to light emitting therefrom, and a vane attached to said pivot arm and movable between said light source and said sensor to control the light from said source to said sensor.

8. Apparatus for dispensing documents as set forth in claim 7 including means for biasing said vane to interrupt the light between said source and said sensor when said rollers are in a rest position.

9. Apparatus for dispensing documents as set forth in claim 5 further comprising:

a second double detector at the storage location that generates a double signal indicating that multiple documents are moving together into the transport path, and separator means responsive to the generated double signal from said second double detector for separating documents removed at the same time from the storage location and for returning all but one of the removed documents to the storage location.

10. Apparatus for dispensing documents as set forth in claim 9 wherein said separator means comprises:

an upper roller operable to move a document through said double detector, a lower roller normally rotatable in response to contact with said upper roller and operable in response to said double detector to rotate in a reverse direction to separate double documents moving through said double detector and to return all but one of the removed documents to the storage location.

11. Apparatus for dispensing documents from a storage location to a discharge area, comprising in combination:

means for transporting documents from the storage location along a transport path, a platform at the storage location for supporting the documents, means responsive to the transporting of documents from the storage location to elevate said platform such that the documents are successively positioned in the transport path, a light source generating a light beam directed towards said platform, a light responsive detector positioned adjacent said light source and responsive to the light emitted therefrom, means on said platform for reflecting light from said source to said detector when all documents have been removed from said platform such that said light responsive detector generates a signal for stopping the dispensing apparatus, a collection station at the end of the transport path and displaced laterally therefrom, said collection station including:

first means immediate the end of the transport path for displacing the trailing edge of a document from the transport path into the collection station, second means at the opposite end of the collection station from said first means for displacing the leading edge of a document delivered from the transport path into the collection station, and means for moving documents at the collection station to the discharge area.

12. Apparatus for dispensing documents as set forth in claim 11 wherein said first and second means for engaging each includes:

a cylinder mounted for rotation at the collection station, and at least one paddle radially extending from the cylinder and engaging an edge of the transported document.

13. Apparatus for dispensing documents as set forth in claim 12 wherein the paddle radially extending from the cylinder comprises an elastomeric flipper.

14. Apparatus for dispensing documents from a storage location to a discharge area, comprising in combination:

means for moving a document from the storage location, a double detector for generating a double signal when more than a single document is removed from the storage location, said double detector including a first roller mounted in a transport path for documents removed from the storage location, a pivot arm, a second roller mounted to the pivot arm juxtaposition said first roller and also in the transport path of documents removed from the storage location, a light source, a light responsive detector positioned from said source and responding to light emitting therefrom, and a vane attached to said pivot arm and movable between said light source and said sensor to control the light from said source to said sensor to generate the double document signal, means for transporting a document removed from the storage location along the transport path, a collection station at the end of the transport path and displaced laterally therefrom, said collection station including:

first means immediate the end of the transport path for displacing the trailing edge of a document from the transport path into the collection station, second means at the opposite end of the collection station from said first means for displacing the leading edge of a document delivered from the transport path into the collection station, and means for moving documents at the collection station to the discharge area.

15. Apparatus for dispensing documents as set forth in claim 14 including means for biasing said vane to interrupt the light between said source and said sensor when said rollers are in a rest position.

16. Apparatus for dispensing documents from a storage location to a discharge location, comprising in combination:

a double detector that generates a double signal indicating that multiple documents are moving together into a transport path, separator means responsive to the generated double signal from said double detector for separating documents removed at the same time from the storage location and for returning all but one of the simultaneously removed documents to the storage location, means for transporting the document removed from the storage location along the transport path, a collection station at the end of the transport path and displaced laterally therefrom, said collection station including:

first means immediate the end of the transport path for displacing the trailing edge of a document from the transport path into the collection station, second means at the opposite end of the collection station from said first means for displacing the leading edge of a document delivered from the transport path into the collection station, and means for moving documents at the collection station to the discharge area.

17. Apparatus for dispensing documents as set forth in claim 16 wherein said separator means comprises:

an upper roller operable to move a document through said double detector, a lower roller normally rotatable in response to contact with said upper roller and operable in response to said double detector to rotate in a reverse direction to separate double documents moving through said double detector and to return all but one of the simultaneously removed documents to the storage location.

18. Apparatus for dispensing documents according to claim 16 wherein said means for moving documents at the collection station to the discharge area comprises:

a pivotable platform frame positioned adjacent the collection station, a roller assembly supported for movement with said platform frame, bands entrained around said roller assembly and rotatable thereabout, and means for pivoting said platform frame such that said bands engage the documents assembled at the collection station to carry the documents to the discharge area.

19. Apparatus for dispensing documents as set forth in claim 18 wherein said means for moving documents at the collection station to the discharge area further includes a retractable stop rotatable from a first position for holding the documents at the collection station to a second position wherein the documents are moved from the collection station.

* * * * *